US006886563B2

(12) United States Patent
Bostock et al.

(10) Patent No.: US 6,886,563 B2
(45) Date of Patent: May 3, 2005

(54) FLAT-FOLDED PERSONAL RESPIRATORY PROTECTION DEVICES AND PROCESSES FOR PREPARING SAME

(75) Inventors: Graham J. Bostock, Darlington (GB); John W. Bryant, Durham (GB); Desmond T. Curran, Durham (GB); Christopher P. Henderson, Durham (GB); Dennis L. Krueger, Hudson, WI (US); James F. Dyrud, New Richmond, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 25 days.

(21) Appl. No.: 10/798,581

(22) Filed: Mar. 11, 2004

(65) Prior Publication Data

US 2004/0237964 A1 Dec. 2, 2004

Related U.S. Application Data

(60) Division of application No. 10/395,975, filed on Mar. 25, 2003, now Pat. No. 6,722,366, which is a division of application No. 09/218,930, filed on Dec. 22, 1998, now Pat. No. 6,568,392, which is a division of application No. 08/612,527, filed on Mar. 8, 1996, now Pat. No. 6,123,077, which is a continuation-in-part of application No. 08/507,449, filed as application No. PCT/US95/02790 on Mar. 9, 1995, now abandoned.

(51) Int. Cl.[7] ..... A62B 18/02
(52) U.S. Cl. ..... 128/206.19; 128/206.12
(58) Field of Search ..... 128/200.24, 206.12, 128/206.13, 206.16, 206.21, 206.17, 206.19, 128/206.22, 206.24, 206.27, 205.29, 207.11; 425/816; 2/206, 9, 454; 156/157, 159, 245; 442/381, 394, 400, 401, 415, 416

(56) References Cited

U.S. PATENT DOCUMENTS 1,523,884 A 1/1925 LeDuc (Continued)

FOREIGN PATENT DOCUMENTS

CA 1296487 3/1992

(Continued)

OTHER PUBLICATIONS

Van A. Wente et al., Report No. 4364 of the Naval Research Laboratories, published May 25, 1954, entitled: "Manufacture of Super Fine Organic Fibers."

(Continued)

*Primary Examiner*—Henry Bennett
*Assistant Examiner*—Teena Mitchell
(74) *Attorney, Agent, or Firm*—Karl G. Hanson

(57) ABSTRACT

Fold-flat personal respiratory protection devices that have a flat substantially rectangular central portion having first and second edges, at flat first member joined to the first edge of the central portion through either a fold-line, seam, weld or bond, said fold, bond, weld or seam of the first member being substantially coextensive with said first edge of said central portion, and a flat second member joined to the second edge of the central portion through either a fold-line, seam, weld or bond, the fold, bond, weld or seam of the second member being substantially coextensive with said second edge of said central portion. At least one of the central portion and first and second members are formed from filter media. The device is capable of being folded flat for storage with the first and second members being in at least partial face-to-face contact with a common surface of the central portion and, during use, is capable of forming a cup-shaped air chamber over the nose and mouth of the wearer with the unjoined edges of the central portion and first and second members adapted to contact and be secured to the nose, cheeks and chin of the wearer. The outer boundary of the unjoined edges which are adapted to contact the nose, cheeks and chin of the wearer are less than the perimeter of the device in the flat folded storage state. Also provided are process for preparing such devices.

17 Claims, 12 Drawing Sheets

U.S. PATENT DOCUMENTS

| | | | |
|---|---|---|---|
| 1,987,922 | A | 1/1935 | Blatt |
| 2,012,505 | A | 8/1935 | Goldsmith |
| 2,029,947 | A | 2/1936 | Schmitt et al. |
| 2,447,450 | A | 8/1948 | Williams |
| 2,565,124 | A | 8/1951 | Durborow |
| 2,762,368 | A | 9/1956 | Bloomfield |
| 3,613,678 | A | 10/1971 | Mayhew |
| 3,664,335 | A | 5/1972 | Boucher et al. |
| 3,971,369 | A | 7/1976 | Aspelin et al. |
| 3,971,373 | A | 7/1976 | Braun |
| 3,985,132 | A | 10/1976 | Boyce et al. |
| 4,100,324 | A | 7/1978 | Anderson et al. |
| 4,118,531 | A | 10/1978 | Hauser |
| 4,215,682 | A | 8/1980 | Kubik et al. |
| 4,248,220 | A | 2/1981 | White |
| 4,300,549 | A | 11/1981 | Parker |
| 4,375,718 | A | 3/1983 | Wadsworth et al. |
| RE31,285 | E | 6/1983 | Turnhout et al. |
| 4,417,575 | A | 11/1983 | Hilton et al. |
| 4,419,993 | A | 12/1983 | Petersen |
| 4,419,994 | A | 12/1983 | Hilton |
| 4,429,001 | A | 1/1984 | Kolpin et al. |
| 4,536,440 | A | 8/1985 | Berg |
| 4,588,537 | A | 5/1986 | Klaase et al. |
| 4,592,815 | A | 6/1986 | Nakao |
| 4,600,002 | A | 7/1986 | Maryyanek et al. |
| 4,625,720 | A | 12/1986 | Lock |
| D287,649 | S | 1/1987 | Zdrok et al. |
| 4,635,628 | A | 1/1987 | Hubbard et al. |
| 4,688,566 | A | 8/1987 | Boyce |
| 4,807,619 | A | 2/1989 | Dyrud et al. |
| 4,825,878 | A | 5/1989 | Kuntz et al. |
| 4,827,924 | A | 5/1989 | Japuntich |
| 4,850,347 | A | 7/1989 | Skov |
| 4,920,960 | A | 5/1990 | Hubbard et al. |
| 4,944,294 | A | 7/1990 | Borek, Jr. |
| 5,020,533 | A | 6/1991 | Hubbard et al. |
| 5,237,986 | A | 8/1993 | Seppala et al. |
| D347,090 | S | 5/1994 | Brunson |
| 5,322,061 | A | 6/1994 | Brunson |
| 5,325,892 | A | 7/1994 | Japuntich et al. |
| 5,429,856 | A | 7/1995 | Krueger et al. |
| 5,446,925 | A | 9/1995 | Baker et al. |
| 5,501,679 | A | 3/1996 | Krueger et al. |
| 5,620,785 | A | 4/1997 | Watt et al. |
| 5,645,057 | A | 7/1997 | Watt et al. |
| 5,673,690 | A | 10/1997 | Tayebi et al. |
| 5,694,925 | A | 12/1997 | Reese et al. |
| 5,706,803 | A | 1/1998 | Bayer |
| 5,720,052 | A | 2/1998 | Walker |
| 5,724,677 | A | 3/1998 | Bryant et al. |
| 5,735,270 | A | 4/1998 | Bayer |
| 5,738,030 | A | 4/1998 | Ok |
| 5,765,556 | A | 6/1998 | Brunson |
| D416,323 | S | 11/1999 | Henderson et al. |
| D424,688 | S | 5/2000 | Bryant et al. |
| 6,070,579 | A | 6/2000 | Bryant et al. |
| 6,092,521 | A | 7/2000 | Miura |
| 6,123,077 | A | 9/2000 | Bostock et al. |
| D431,647 | S | 10/2000 | Henderson et al. |
| 6,148,817 | A | 11/2000 | Bryant |
| D459,471 | S | 6/2002 | Curran et al. |
| 6,436,529 | B1 | 8/2002 | Deeb et al. |
| 6,484,722 | B2 | 11/2002 | Bostock et al. |
| 6,536,434 | B1 | 3/2003 | Bostock et al. |
| 6,568,392 | B1 | 5/2003 | Bostock et al. |
| 6,715,489 | B2 | 4/2004 | Bostock et al. |
| 6,722,366 | B2 | 4/2004 | Bostock et al. |

FOREIGN PATENT DOCUMENTS

| | | |
|---|---|---|
| EP | 0183059 A1 | 6/1986 |
| FR | 1220851 | 1/1960 |
| GB | 134432 | 1/1919 |
| GB | 388638 | 3/1933 |
| GB | 871661 | 6/1961 |
| GB | 2057891 | 4/1981 |
| GB | 2072516 | 10/1981 |
| GB | 2103491 A | 2/1983 |
| WO | WO89/10106 | 11/1989 |
| WO | WO94/19976 | 9/1994 |
| WO | WO96/28216 | 9/1996 |
| WO | WO96/28217 | 9/1996 |
| WO | WO97/32493 | 9/1997 |
| WO | WO97/32494 | 9/1997 |
| WO | WO98/31743 | 7/1998 |

OTHER PUBLICATIONS

Van A. Wente et al., "Superfine Thermoplastic Fibers,"*Industrial and Engineering Chemistry*, vol. 48, pp. 1342-1246.

C. N. Davies, "The Separation of Airborne Dust and Particles,"*Institution of Mechanical Engineers,* London, Proceedings 1B, 1952.

"Disposable Dust Respirator," FLATMATE product information from Martindale Protection, Limited.

"The Next Generation in Safety," product information from Europa Safety Products.

"The CN Particle Filter Masks Meet the Demands of the Industry," product information from Partikelfilter.

"Fold Flat Disposable Respirators," product information from Blagden Alphasolway (1992).

"DELTA Filtering Half Mask," product information from Racal Health & Safety.

Product Literature: "Glendale Respiratory Protection," Glendale Optical Company, Inc., (2/83).

Product Literature: "Delta Disposable Respirators," Racal Health & Safety, Inc., (1993).

FLAT-FOLDED PERSONAL RESPIRATORY PROTECTION DEVICES AND PROCESSES FOR PREPARING SAME

This application is a division of application Ser. No. 10/395,975 filed on Mar. 25, 2003 Now U.S. Pat. No. 6,722,366, which is a division of application Ser. No. 09/218,930 filed on Dec. 22, 1998 (now U.S. Pat. No. 6,568,392), which is a division of application Ser. No. 08/612,527 filed on Mar. 8, 1996 (now U.S. Pat. No. 6,123,077), which is a continuation-in-part of application Ser. No. 08/507,449, having a U.S. filing date of Sep. 11, 1995 (now abandoned), from International Application US95/02790 (WO 95/02790) filed under the Patent Cooperation Treaty on Mar. 9, 1995.

FIELD OF THE INVENTION

The present invention relates to respirators or face masks which are capable of being folded flat during storage and forming a cup-shaped air chamber over the mouth and nose of a wearer during use.

BACKGROUND OF THE INVENTION

Filtration respirators or face masks are used in a wide variety of applications when it is desired to protect a human's respiratory system from particles suspended in the air or from unpleasant or noxious gases. Generally such respirators or face masks are of one of two types—a molded cup-shaped form or a flat-folded form. The flat-folded form has advantages in that it can be carried in a wearer's pocket until needed and re-folded flat to keep the inside clean between wearings.

The flat-folded form of face mask has been constructed as a fabric which is rectangular in form and has pleats running generally parallel to the mouth of the wearer. Such constructions may have a stiffening element to hold the face mask away from contact with the wearer's face. Stiffening has also been provided by fusing a pleat across the width of the face mask in a laminated structure or by providing a seam across the width of the face mask.

Also disclosed is a pleated respirator which is centrally folded in the horizontal direction to form upper and lower opposed faces. The respirator has at least one horizontal pleat essentially central to the opposed faces to foreshorten the filter medium in the vertical dimension and at least one additional horizontal pleat in each of these opposed faces. The central pleat is shorter in the horizontal dimension relative to the pleats in the opposed faces which are shorter in the horizontal dimension relative to the maximum horizontal dimension of the filter medium. The central pleat together with the pleats in opposed faces form a self-supporting pocket.

Also disclosed is a respirator made from a pocket of flexible filtering sheet material having a generally tapering shape with an open edge at the larger end of the pocket and a closed end at the smaller end of the pocket. The closed end of the pocket is formed with fold lines defining a generally quadrilateral surface comprising triangular surfaces which are folded to extend inwardly of the pocket, the triangular surfaces facing each other and being in use, relatively inclined to each other.

More complex configurations which have been disclosed include a cup-shaped filtering facepiece made from a pocket of filtering sheet material having opposed side walls, a generally tapering shape with an open end at the larger end and a closed end at the smaller end. The edge of the pocket at the closed end is outwardly bowed, e.g. defined by intersecting straight lines and/or curved lines, and the closed end is provided with fold lines defining a surface which is folded inwardly of the closed end of the pocket to define a generally conical inwardly extending recess for rigidifying the pocket against collapse against the face of the wearer on inhalation.

Further disclosed is face mask having an upper part and a lower part with a generally central part therebetween. The central part of the body portion is folded backwardly about a vertical crease or fold line which substantially divides it in half. This fold or crease line, when the mask is worn, is more or less aligned with an imaginary vertical line passing through the center of the forehead, the nose and the center of the mouth. The upper part of the body portion extends upwardly at an angle from the upper edge of the central part so that its upper edge contacts the bridge of the nose and the cheekbone area of the face. The lower part of the body portion extends downwardly and in the direction of the throat form the lower edge of the center part so as to provide coverage underneath the chin of the wearer. The mask overlies, but does not directly contact, the lips and mouth of the wearer.

SUMMARY OF THE INVENTION

The present invention provides a personal respiratory protection device comprising a flat central portion having first and second edges, a flat first member joined to the first edge of the central portion through either a fold-line, seam, weld or bond, said fold, bond, weld or seam of said first member being substantially coextensive with said first edge of said central portion, and a flat second member joined to the second edge of the central portion through either a fold-line, seam, weld or bond, said fold, bond, weld or seam of said second member being substantially coextensive with said second edge of said central portion, at least one of the central portion and first and second members being formed from filter media, and said device being capable of being folded flat for storage with said first and second members being in at least partial face-to-face contact with a common surface of said central portion and, during use, being capable of forming a cup-shaped air chamber over the nose and mouth of the wearer with the unjoined edges of the central portion and first and second members adapted to contact and be secured to the nose, cheeks and chin of the wearer and the outer boundary of the unjoined edges which are adapted to contact the nose, cheeks and chin of the wearer being less than the perimeter of the device in the flat folded storage state. Additional portions may be optionally attached to the unjoined edges of the first and second members. Additional portions may be optionally attached to the central portion.

The configuration of the flat-folded respiratory device may be rectangular to substantially elliptical. The respiratory device, when unfolded for use, is substantially cup-shaped. The filter media which comprises at least one of the first member, central portion and second member may be a nonwoven fabric such as one formed from microfibers or may be of several layers, each layer having similar or dissimilar filtering properties. The filter media may, of course, also comprise any two or all of the first member, central portion and second member as well as the additional portions.

The respiratory devices of the present invention may further comprise headbands or other means such as adhesive for holding the respiratory device in place on the face of the wearer, nose clips or any other means to provide good contact of the respiratory device with the nose of the wearer, exhalation valves, and other accouterments common to respirators and facemasks such as, for example, face seals, eye shields and neck coverings. When the respiratory device is constructed with a nose clip, the nose clip may be on the outer portion of the first member of the respiratory device and a cushioning member such as a piece of foam can be placed directly below the nose clip on the inner surface of the first member or the nose clip may be on the inner surface of the first member and a cushioning member can be placed covering the nose clip or when the respiratory device comprises multiple layers, the nose clip may be placed between layers.

The respiratory devices of the present invention include, for example, respirators, surgical masks, clean room masks, face shields, dust masks, breath warming masks, and a variety of other face coverings. The respiratory devices of the present invention can be designed to provide better sealing engagement with the wearer's face than some other types of cup-shaped respirators or face masks which contact the wearer's face at the periphery of the respirator at an acute angle with minimal contact region, thereby increasing discomfort to the wearer and potentially minimizing the engagement of the seal at the perimeter of the respirator.

Additionally provided is a process for producing personal respiratory devices to afford respiratory protection to a wearer comprising a) forming a flat central portion, said central portion having at least a first edge and a second edge;

b) attaching a flat first member to said central portion at the first edge of said central portion with a fold, bond, weld or seam, said fold, bond, weld or seam edge of said first member being substantially coextensive with said first edge of said central portion;

c) attaching a flat second member to said central portion at the second edge of said central portion with a fold, bond, weld or seam, said fold, bond, weld or seam edge of said second member being substantially coextensive with said second edge of said central portion;

with the proviso that at least one of said central portion, first member and second member comprises filter media and said device being capable of being folded flat for storage and, during use, being capable of forming a cup-shaped air chamber over the nose and mouth of the wearer, and the unjoined edges of the central portion, first member and second member adapted to contact and be secured to the nose, cheeks and chin of the wearer and the outer boundary of the unjoined edges which are adapted to contact the nose, cheeks and chin of the wearer being less than the perimeter of the device in the flat folded storage state. Additional portions may be optionally attached to the unjoined edges of the first and second members.

Also provided is a process for producing personal respiratory protection devices comprising the steps of forming a rectangular sheet of filtering media, folding a first long edge toward the center of the sheet to form a first member, folding the second long edge toward the center of the sheet to form a second member and sealing the nonfolded edges. The process may optionally include additional portions attached to the first and second members at their unfolded edges through additional folds or bonds.

Further provided is a process for preparing personal respiratory protection devices comprising forming a first elliptical sheet of filter media having two edges, forming a second elliptical sheet of filter media having two edges, at least one side of each sheet having a common shape, bonding the common shaped edges, folding the unbonded edge of said second sheet toward the bonded edge, forming a third elliptical sheet of filter media having two edges, at least one edge of which has a common shape with the unbonded edge of said first sheet, placing said third sheet on said second sheet and bonding the common shaped edges of said first and third sheet.

Each process is amenable to high speed production methods and may comprise additional steps as needed for attachment of headbands, nose clips, and other typical respiratory device components.

DETAILED DESCRIPTION OF THE INVENTION

Figure 1:
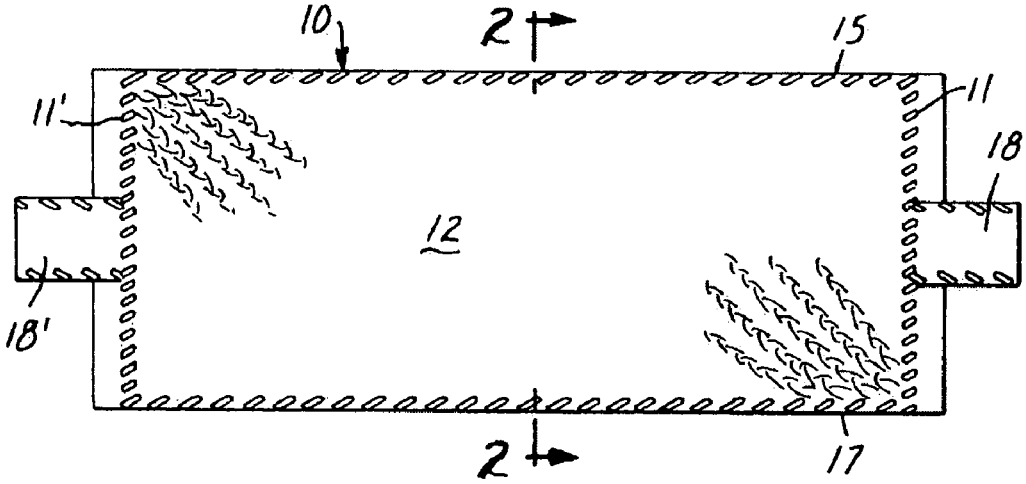
FIG. 1 is a front view of a personal respiratory protection device of the invention in flat-fold configuration.
Figure 2:
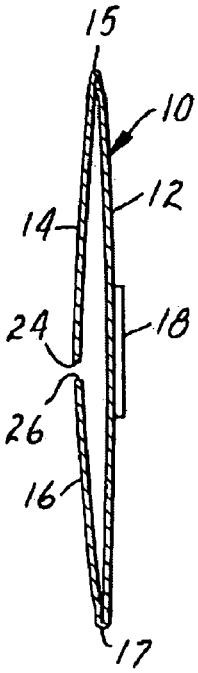
FIG. 2 is a cross-section taken along line 2—2 of the personal respiratory protection device shown in FIG. 1.
Figure 3:
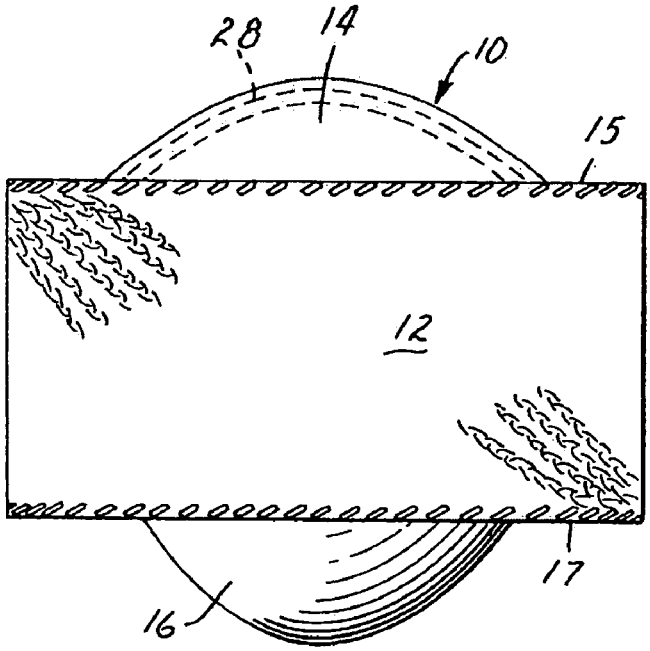
FIG. 3 is front view of the personal respiratory protection device of FIG. 1 shown in open ready-to-use configuration.

In one embodiment of the invention as shown in FIG. 1, a front view of personal respiratory protection device 10, the device has a generally rectangular shape when in the folded form for storage in a package prior to use or in a wearer's pocket. A side view of personal respiratory protection device 10, shown in FIG. 2, shows the device having a central portion 12, a first member 14 and second member 16. The central portion and the first and second members are joined, for example, as shown in FIG. 2 by folds 15 and 17, or the first and second members may be bonded or seamed to the central portion. The configuration is held in place by edge seals 11 and 11' which may extend from fold 15 to fold 17 as shown or they may extend partially from fold 15 to fold 17. Edge seals 11 and 11' may be substantially straight as shown or they may be curved. FIGS. 1 and 3 also show attachment means 18, 18' for attaching, for example, a head band to hold the device in place on a wearer's face. When the device is a multilayer construction, having, for example, filter media layer(s), an optional cover layer, and an optional stiffening layer, the perimeter edges of first and second members 14 and 16 are also bonded.

Figure 4:
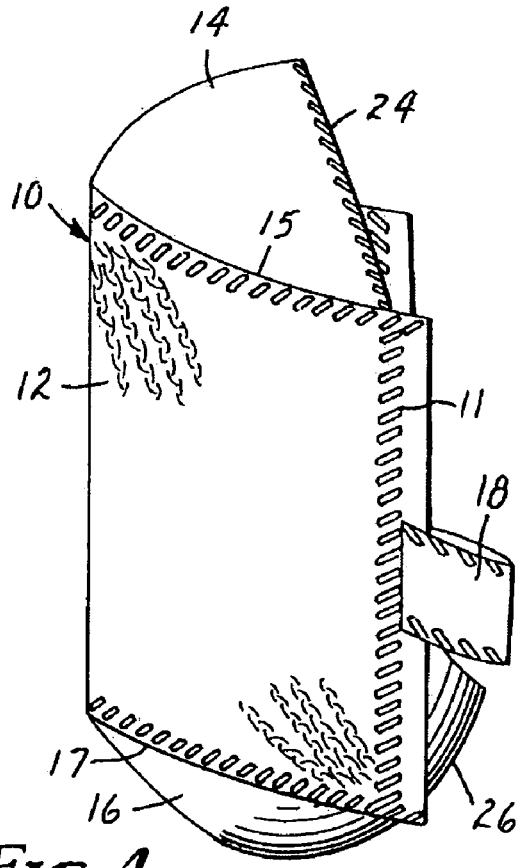
FIG. 4 is a side view of the personal respiratory protection device of FIG. 1 shown in open ready-to-use configuration.

The personal respiratory protection device 10 is shown in FIGS. 3, and 4, where common parts are identified as in FIGS. 1 and 2, in its opened, ready-to wear configuration having the general shape of a cup or pouch which provides the wearer with the "off-the-face" benefits of a molded cup-shaped respiratory device. The cup-shaped "off-the-face" design of the respiratory device of the invention provides a periphery region formed by edges 24 and 26 of the first and second members, respectively, for sealing the respiratory device against the face of the wearer. FIG. 3 shows personal respiratory protection device 10 with optional nose clip 28. To allow the wearer a greater degree of jaw movement, a generally widthwise fold, or pleat, can be formed in first member 14 or second member 16 of the respiratory device, just above the fold or bond 15 or just below the fold or bond 17.

Figure 6:
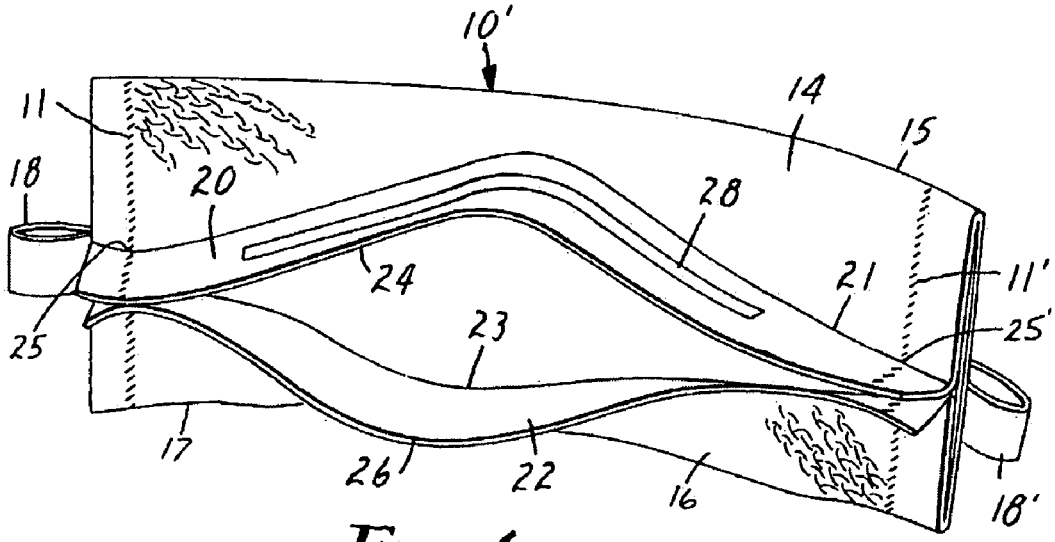
FIG. 6 is a perspective view of the personal respiratory protection device of FIG. 5 shown partially open.
Figure 5:
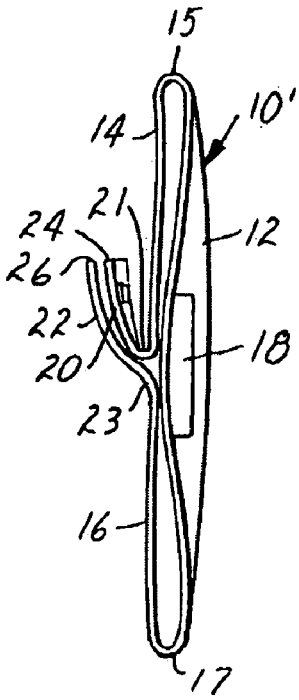
FIG. 5 is a cross-sectional view of another embodiment of a personal respiratory protection device of the present invention in flat-fold configuration.

In another embodiment shown in FIGS. 5 and 6, where common parts are identified as in FIGS. 1–4, additional members 20 and 22 are attached to the first and second members 14 and 16 of respiratory device 10' by folds 21 and 23 or by bonding or seaming (not shown). Additional members 20 and 22 may be sealed with central portion 12 and first and second members 14 and 16 at edge seals 11, 11', but preferably are not sealed at the edge seals as shown in FIGS. 5 and 6 to provide enhanced sealing at the periphery of respiratory device 10' due to the ability of the additional portions 20 and 22 to pivot at the attachment points 25 and 25'. FIG. 6 shows respiratory device 10' with optional nose clip 28 located on additional member 20. In this embodiment, when multiple layers are used to form the respiratory device, perimeter edges of additional members 20 and 22 are also preferably bonded.

The width of the central portion 12 of personal respiratory protection device 10 extending between edge seals 11 and 11' or bonds located in the same position as edge seals 11 and 11' is preferably about 160 to 220 mm in width, more preferably about 175 to 205 mm, most preferably about 185 to 190 mm in width. The height of central portion 12 of respiratory device 10 extending between folds 15 and 17 is preferably about 30 to 110 mm in height, more preferably about 50 to 100 mm in height, most preferably about 75 to 80 mm in height. The width of first member 14 and second member 16 of respiratory device 10 are preferably about the same as that of central portion 12. The depth of first member 14 extending from fold 15 to the peripheral edge of first member 14 of respiratory device 10 or fold 21 of respiratory device 10' is preferably about 30 to 110 mm, more preferably about 50 to 70 mm, most preferably about 55 to 65 mm. The depth of second member 16 extending from fold 17 to the peripheral edge of second member 16 of respiratory device 10 to fold 23 of respiratory device 10' is preferably about 30 to 110 mm, more preferably about 55 to 75 mm, most preferably about 60 to 70 mm. The depths of first member 14 and second member 16 may be the same or different and the sum of the depths of the first and second members preferably does not exceed the height of the central portion. Additional members 20 and 22 in respiratory device 10' are preferably about the same width as first and second members 14 and 16. Additional member 20 in respiratory device 10' is preferably about 1 to 95 mm, more preferably about 5 to 40 mm, most preferably about 5 to 30 mm in depth. Additional member 22 of respiratory device 10' is preferably about 1 to 95 mm more preferably about 3 to 75 mm, most preferably about 3 to 35 mm in depth. End edge seals are preferably at about 1 to 25 mm, more preferably about 5–10 mm from the outer edges of central portion 12, first member 14 and second member 16 and are preferably 1 to 10 mm in width, more preferably 2 to 5 mm in width. When additional portions 20 and 22 are present as in respiratory device 10' such portions may be, but preferably are not, included in edge seals 11, 11'. In such respiratory devices as 10 and 10', the outer boundary of the unjoined edges which contact the nose, cheeks and chin of the wearer in the open configuration shown in FIGS. 3, 4 and 6 are less than the perimeter of the device in the flat folded storage state.

Figure 7:
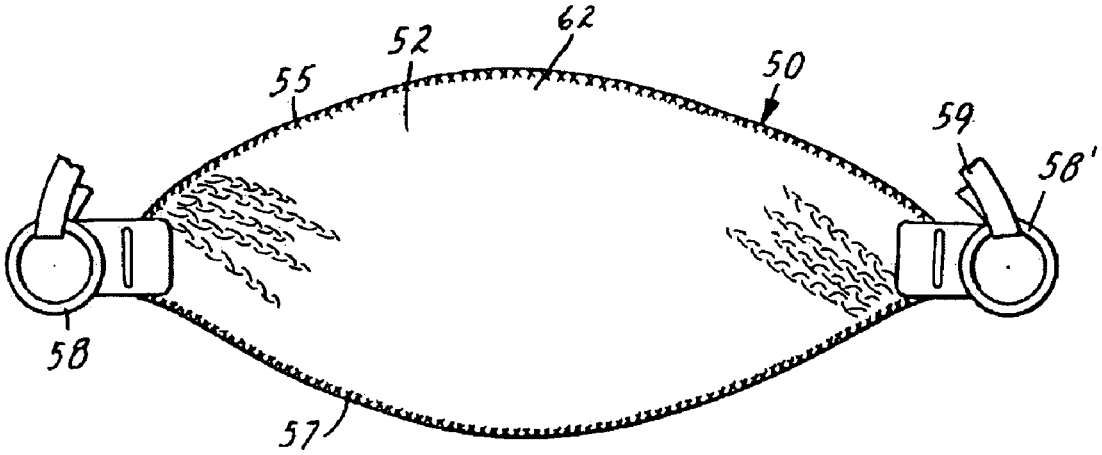
FIG. 7 is a front view of another embodiment of a personal respiratory protection device of the present invention in flat-fold configuration.
Figure 8:
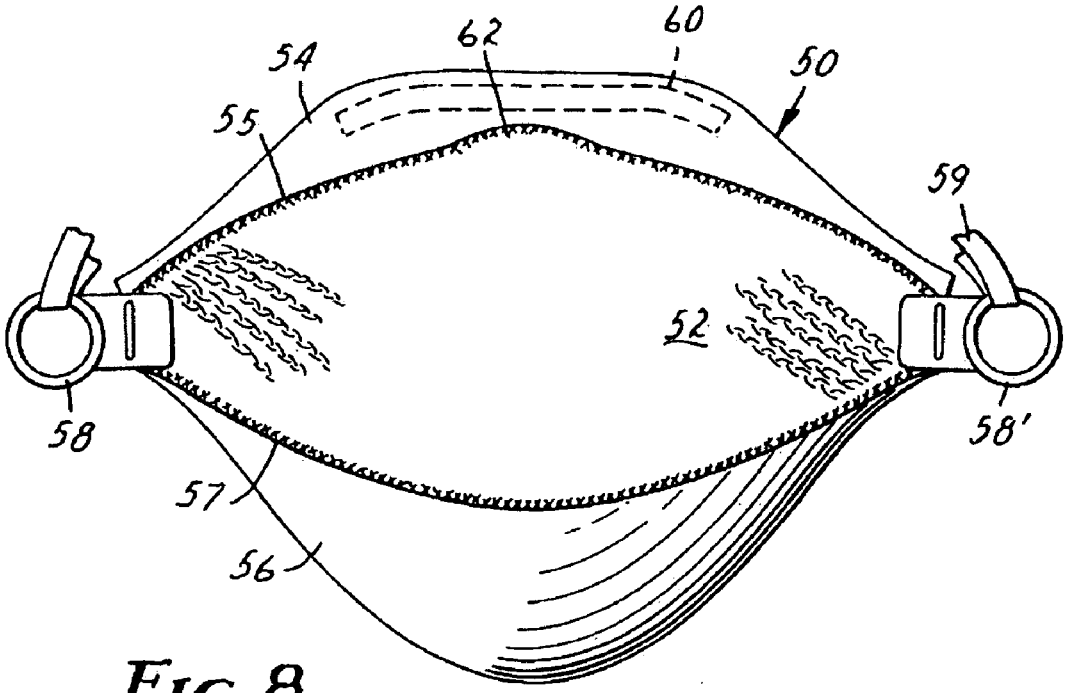
FIG. 8 is a front view of the personal respiratory protection device of FIG. 7 shown in open ready-to-use configuration.
Figure 9:
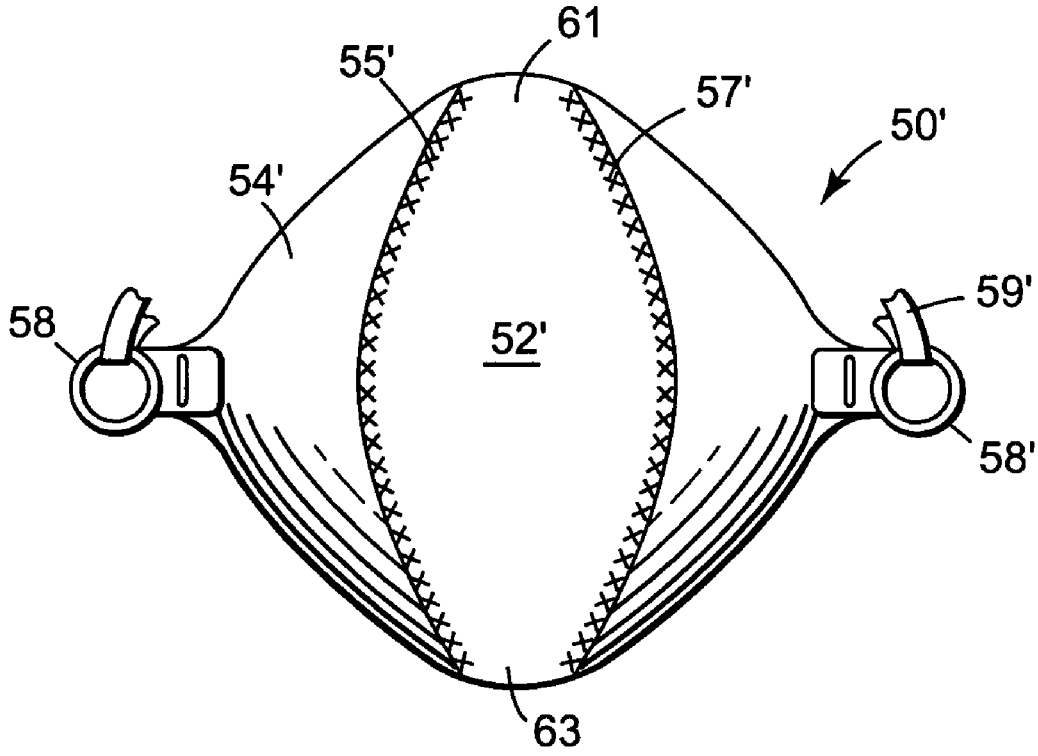
FIG. 9 is a front view of another embodiment of a personal respiratory protection device of the present invention.

A further embodiment which is referred to as being elliptical in shape is shown in FIGS. 7, 8, 9, 10, 11 and 12. In FIG. 7, respiratory device 50, shown in front view in its folded, or storage configuration, includes a central portion 52, and bonds 55 and 57. Also shown are attachment means 58, 58' for attaching, for example, a head band 59 to hold the respiratory device in place on a wearer's face. In FIG. 8, respiratory device 50 is shown in front view in its ready-for-use unfolded configuration with first member 54 bonded to central portion 52 at bond 55 and second member 56 bonded to central portion 52 at bond 57. When the respiratory device is formed of multiple layers of material, the perimeter edges of first member 54 and second member 56 are also preferably bonded. FIG. 8 further shows a nose clip 60 on first member 54 and a protrusion 62 on central portion 52, with a comparable mating protrusion on first member 54 (not shown) Nose clip 60 provides improved fit and protrusion 62 with its sister protrusion on first member 54 provides improved comfort and fit. In some cases, an improvement in fit can be obtained by folding the outer edge of first member 54 inwards, i.e., towards the face of a wearer. Nose clip 60, if present, can be located inside the fold. To allow the wearer a greater degree of jaw movement, a generally widthwise fold, or pleat, can be formed in first member 54 or in second member 56 of the respiratory device, just below the fold or bond 57. In such respiratory devices as 50 and 50', the outer boundary of the unjoined edges which contact the nose, cheeks and chin of the wearer in the open configuration shown in FIGS. 8 and 9 are less than the perimeter of the device in the flat folded storage state.

Figure 11:
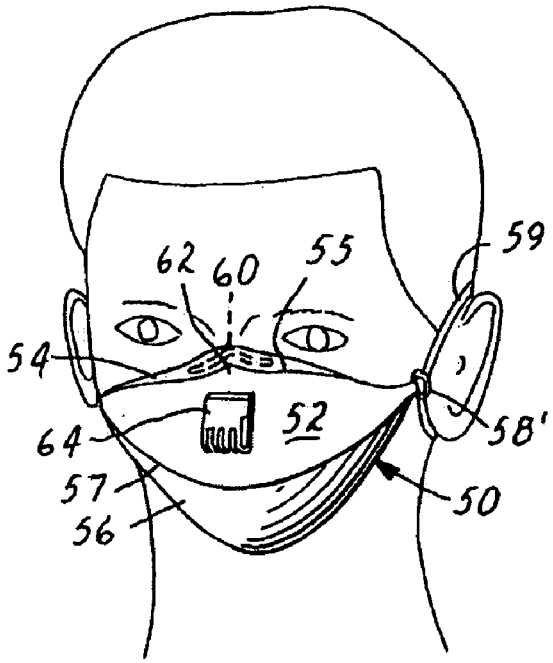
FIG. 11 is a front view of another embodiment of a personal respiratory protection device of the present invention.
Figure 12:
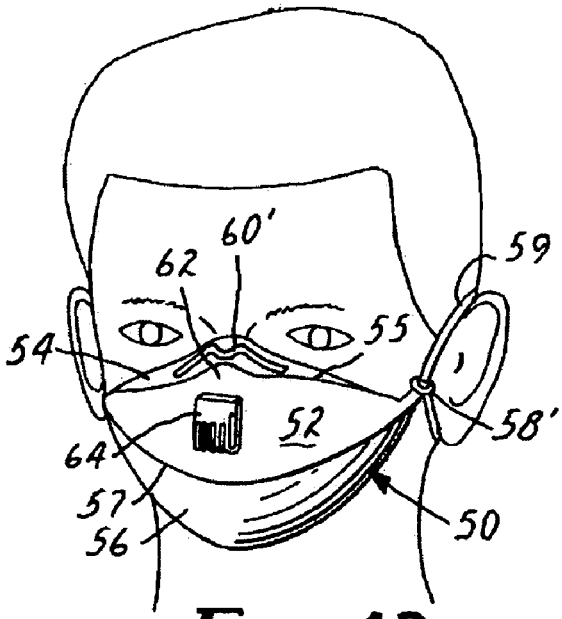
FIG. 12 is a front view of another embodiment of a personal respiratory protection device of the present invention.
Figure 10:
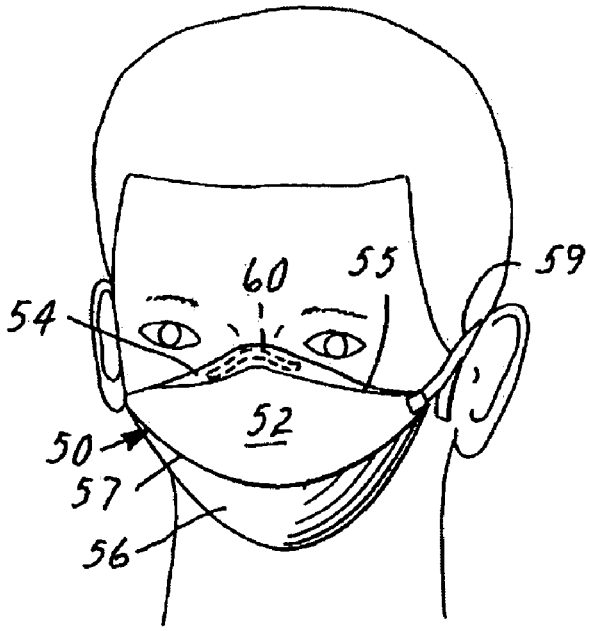
FIG. 10 is a front view of another embodiment of a personal respiratory protection device of the present invention.
Figure 13A:
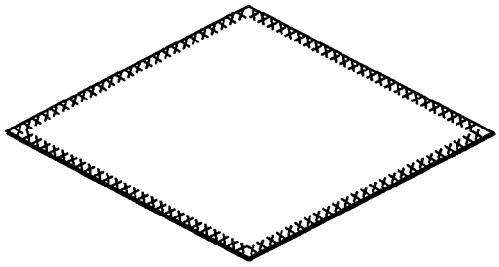
FIGS. 13*a*–13*p* are front views of various additional alternative embodiments of the present invention.
Figure 13B:
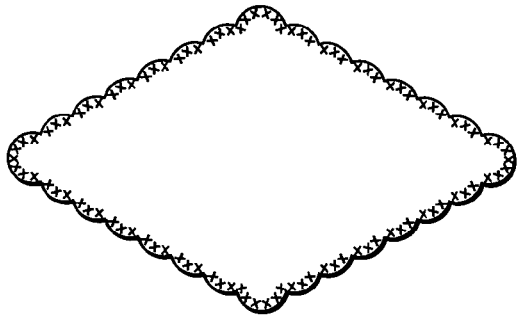
Figure 13C:
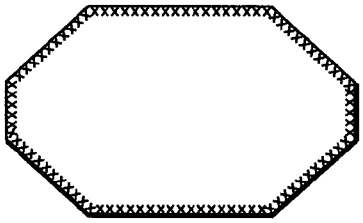
Figure 13D:
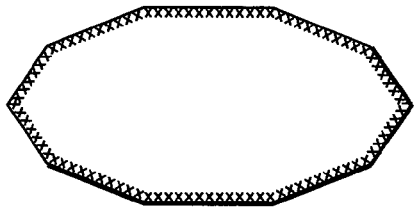
Figure 13E:
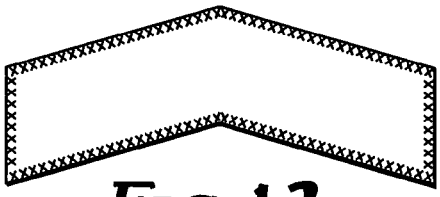
Figure 13F:
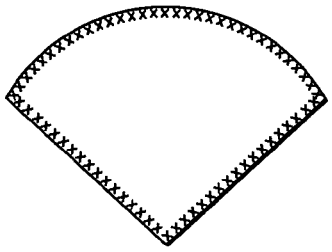
Figure 13G:
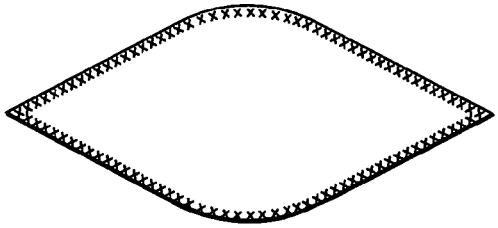
Figure 13H:
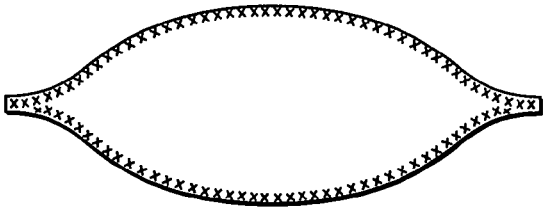
Figure 13I:
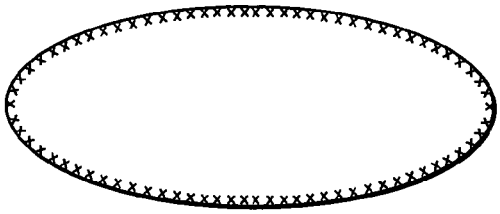
Figure 13J:
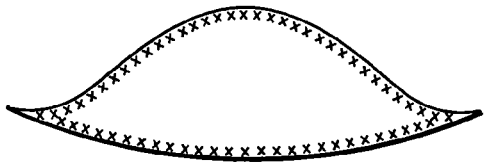
Figure 13K:
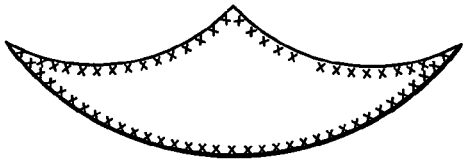
Figure 13L:
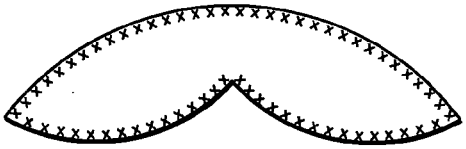
Figure 13M:
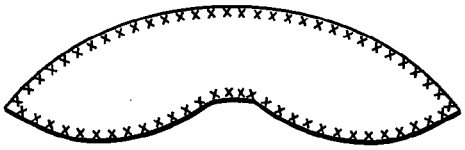
Figure 13N:
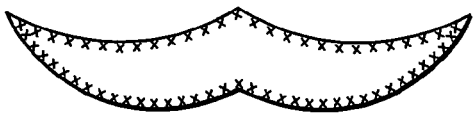
Figure 13O:
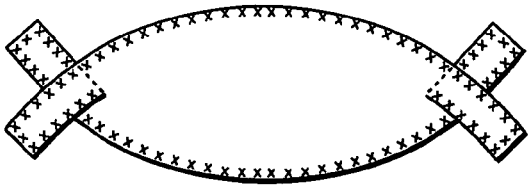
Figure 13P:
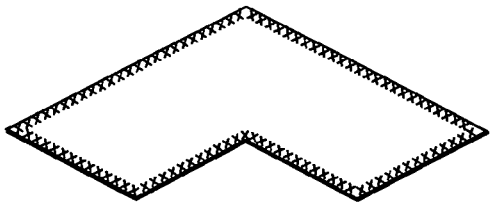

In FIGS. 10, 11 and 12, respiratory device 50 is shown on the face of a wearer and having a cup-shaped configuration with nose clip 60 being shown in FIG. 10, nose clip 60 and exhalation valve 64 being shown in FIG. 11 and nose clip 60' and exhalation valve 64 being shown in FIG. 12. Such nose clips and exhalation valves can be equally useful on the respiratory devices shown in FIGS. 1–6.

In the respiratory devices shown in FIGS. 7, 8, 10, 11, and 12 the width at the widest portion of central portion 52 is preferably about 160 to 220 mm, more preferably about 175 to 205 mm, most preferably about 193 to 197 mm. The height at the highest portion of the central portion, perpendicular to the width, is preferably about 30 to 110 mm, more preferably about 50 to 100 mm, most preferably about 70 to 80 mm. Preferably, the first and second members are substantially the same width as the central portion. The depth at the deepest part of the first member is preferably about 30 to 110 mm, more preferably about 40 to 90 mm, most preferably about 50 to 60 mm. The depth at the deepest part of the second member is preferably about 30 to 110 mm, more preferably about 50 to 100 mm, most preferably about 60 to 70 mm. The depths of the first and second members may be the same or different. When the depth of the second member is greater than that of the first portion, additional protection can be provided to the chin area. By adjusting the depths of the first and second members as well as the central portion, the fit of the second member under the chin can be adjusted or the fit of the first portion over the nose can be adjusted so that the first portion rests along the length of the nose or rests predominantly on the bridge of the nose. In the personal respiratory protection device shown in FIG. 9, the respiratory device 50' is configured such that central portion 52', first member 54' and second member 56' rest vertically on a wearer's face with the end portions 61 and 63 of central portion 52' resting on the nose and chin of the wearer. First member 54' is bonded to central portion 52' at bond 55' and second member 56' is bonded to central portion 52' at bond 57'. Attachment means 58', 58" are provided for attaching, for example, a head band 59' to hold the respiratory device in place on a wearer's face. Of course, the respiratory device shown in FIGS. 1–6 could be similarly modified by changing the location of the attachment means 18, 18'. In such configurations where the central portion, first member and second member are vertically aligned with the wearer's face, The distance between the attachment means is preferably about 160 to 220 mm, more preferably about 170 to 190 mm for the substantially elliptical shaped device and about 175 to 195 mm for the substantially rectangular device.

The shape of the flat-folded personal respiratory protection device, although referred to as generally elliptical with regard to FIGS. 7–12 may vary greatly. It will typically not be a regular ellipse and could, for example, even approach a rhomboid. Various possible shapes of the folded device are shown in FIGS. 13(*a*) to 13(*p*). Thus, a quadrant of the central portion could have a bonded edge configuration approaching a right angle or approaching forming a straight line or a pattern comprising a combination of curves and/or straight lines. Preferably, such a bonded edge has a configuration such as a gentle curve as shown in FIG. 7, more preferably the curve has a radius of about 120 to 170 mm, most preferably about 140 to 150 mm. Similarly, the shape of the first and second members and the additional portions may vary considerably. Each of the first and second members must be shaped such that they can be joined to the central portion as previously described. The shape of the unattached edge portions of the first and second members may also vary from straight to curvilinear as desired to achieve good fit to the wearer's face. The additional members, when present, must have an edge portion suitable for joining with the first or second edge portion as appropriate. The shape of the unjoined edge portions can range from straight to curvilinear. By varying the shape of the joined portions, the fit of the respiratory device to the face can be improved by selected design. The bonds connecting the central portion with the first and second members and the additional members with the first and second members, respectively, are preferably no more than about 15 mm deep from the edges of the central portion and first member or the edges of the first and second member, more preferably no more than about 10 mm deep, most preferably no more than about 5 mm deep and may be continuous or discontinuous.

The filter media or material useful in the present invention which must comprise at least one of the central portion, first member or second member may be comprised of a number of woven and nonwoven materials, a single or a plurality of layers, with or without an inner or outer cover or scrim, and with or without a stiffening means. Preferably, the central portion is provided with stiffening means such as, for example; woven or nonwoven scrim, adhesive bars, printing or bonding. Examples of suitable filter material include microfiber webs, fibrillated film webs, woven or nonwoven webs (e.g., airlaid or carded staple fibers), solution-blown fiber webs, or combinations thereof. Fibers useful for forming such webs include, for example, polyolefins such as polypropylene, polyethylene, polybutylene, poly(4-methyl-1-pentene) and blends thereof, halogen substituted polyolefins such as those containing one or more chloroethylene units, or tetrafluoroethylene units, and which may also contain acrylonitrile units, polyesters, polycarbonates, polyurethanes, rosin-wool, glass, cellulose or combinations thereof.

Fibers of the filtering layer are selected depending upon the type of particulate to be filtered. Proper selection of fibers can also affect the comfort of the respiratory device to the wearer, e.g., by providing softness or moisture control. Webs of melt blown microfibers useful in the present invention can be prepared as described, for example, in Wente, Van A., "Superfine Thermoplastic Fibers" in *Industrial Engineering Chemistry*, Vol. 48, 1342 et seq. (1956) and in Report No. 4364 of the Navel Research Laboratories, published May 25, 1954, entitled "Manufacture of Super Fine Organic Fibers" by Van A. Wente et al. The blown microfibers in the filter media useful on the present invention preferably have an effective fiber diameter of from 3 to 30 micrometers, more preferably from about 7 to 15 micrometers, as calculated according to the method set forth in Davies, C. N., "The Separation of Airborne Dust Particles", Institution of Mechanical Engineers, London, Proceedings 1B, 1952.

Staple fibers may also, optionally, be present in the filtering layer. The presence of crimped, bulking staple fibers provides for a more lofty, less dense web than a web consisting solely of blown microfibers. Preferably, no more than 90 weight percent staple fibers, more preferably no more than 70 weight percent are present in the media. Such webs containing staple fiber are disclosed in U.S. Pat. No. 4,118,531 (Hauser), which is incorporated herein by reference.

Bicomponent staple fibers may also be used in the filtering layer or in one or more other layers of the filter media. The bicomponent staple fibers which generally have an outer layer which has a lower melting point than the core portion can be used to form a resilient shaping layer bonded together at fiber intersection points, e.g., by heating the layer so that the outer layer of the bicomponent fibers flows into contact with adjacent fibers that are either bicomponent or other staple fibers. The shaping layer can also be prepared with binder fibers of a heat-flowable polyester included together with staple fibers and upon heating of the shaping layer the binder fibers melt and flow to a fiber intersection point where they surround the fiber intersection point. Upon cooling, bonds develop at the intersection points of the fibers and hold the fiber mass in the desired shape. Also, binder materials such as acrylic latex or powdered heat activatable adhesive resins can be applied to the webs to provide bonding of the fibers.

Electrically charged fibers such as are disclosed in U.S. Pat. No. 4,215,682 (Kubik et al.), U.S. Pat. No. 4,588,537 (Klasse et al.) which are incorporated herein by reference, or by other conventional methods of polarizing or charging electrets, e.g., by the process of U.S. Pat. No. 4,375,718 (Wadsworth et al.), or U.S. Pat. No. 4,592,815 (Nakao), which are incorporated herein by reference are particularly useful in the present invention. Electrically charged fibrillated-film fibers as taught in U.S. Pat. No. RE. 31,285 (van Turnhout), also incorporated herein by reference, are also useful. In general the charging process involves subjecting the material to corona discharge or pulsed high voltage.

Sorbent particulate material such as activated carbon or alumina may also be included in the filtering layer. Such particle-loaded webs are described, for example, in U.S. Pat. No. 3,971,373 (Braun), U.S. Pat. No. 4,100,324 (Anderson) and U.S. Pat. No. 4,429,001 (Kolpin et al.), which are incorporated herein by reference. Masks from particle loaded filter layers are particularly good for protection from gaseous materials.

At least one of the central portion, first member and second member of a respiratory device of the present invention must comprise filter media. Preferably at least two of the central portion, first member and second member comprise filter media and all of the central portion, first member and second member may comprise filter media. The portion(s) not formed of filter media may be formed of a variety of materials. The first member may be formed, for example, from a material which provides a moisture barrier to prevent fogging of a wearer's glasses. The central portion may be formed of a transparent material so that lip movement by the wearer can be observed.

Where the central portion is bonded to the first and/or second members, bonding can be carried out by ultrasonic welding, adhesive bonding, stapling, sewing, thermomechanical, pressure, or other suitable means and can be intermittent or continuous. Any of these means leaves the bonded area somewhat strengthened or rigidified. Such bonding means are also suitable for securing the end portions of the respiratory devices shown in FIGS. 1–6.

The respiratory devices of the present invention are preferably held in place on a wearer's face by means well-known to those skilled in the art such as by adhesive or with straps or headbands secured to the respiratory device main body, formed by the central portion and first and second members of the respiratory device, or additional portion(s) of the respiratory device, at outboard positions on either the outer or inner surface of the respiratory device by such means as loops which may be integrally formed with the respiratory device shown in, for example, FIGS. 1 and 2, or they may be adhered to the main body of the respiratory device by means such as embossing, stapling, adhesive bonding, ultrasonic welding, sewing or other means commonly known to those skilled in the art. Alternatively, the straps or headbands may be directly attached to the respiratory device main body using means similar to those described for securement of the loop attachment means. Preferably, the headband has some degree of adjustability to effect tension against the wearer's face.

Straps or headbands useful in the present invention may be constructed from resilient polyurethane, polyisoprene, butylene-styrene copolymers such as, for example, KRATON™ thermoplastic elastomers available from Shell Chemical Co., but also may be constructed from elastic rubber, or a covered stretch yarn such as LYCRA™ spandex available from DuPont Co.

Also useful for straps or headbands in the present invention are stretch activated, elastomeric composite materials. One such material is a non-tacky, multi-layer elastomeric laminate having at least one elastomeric core and at least one relatively nonelastomeric skin layer. The skin layer is stretched beyond its elastic limit and is relaxed with the core so as to form a microstructured skin layer. Microstructure means that the surface contains peak and valley irregularities or folds which are large enough to be perceived by the unaided human eye as causing increased opacity over the opacity of the composite before microstructuring, and which irregularities are small enough to be perceived as smooth or soft to human skin. Magnification of the irregularities is required to see the details of the microstructured texture. Such an elastomeric composite is disclosed in allowed U.S. patent application Ser. No. 07/503,716, filed Mar. 30, 1990, which is hereby incorporated by reference.

Non-elastic bands useful in the present invention include, for example, non-woven materials formed by both wet-laid or dry-laid processes and consisting of rayon, polyester or like fibers, calendared spun-bonded webs of polypropylene, polyethylene or polyester and reinforced paper. The bands may either be tied, clasped, or stretched such that the bands encircle the head of the wearer bringing the facemask in sealing engagement with the face of the wearer.

Alternative band designs also can include open-loop or closed loop constructions to encircle the head of the wearer or loop over the ears of the wearer. U.S. Pat. No. 5,237,986 (Seppala et al.) discloses a headband assembly which enables the mask to be easily and quickly applied, and provides for temporary storage during non-use periods.

A nose clip useful in the respiratory device of the present invention may be made of, for example, a pliable dead-soft band of metal such as aluminum or plastic coated wire and can be shaped to fit the device comfortably to a wearer's face. Particularly preferred is a non-linear nose clip configured to extend over the bridge of the wearer's nose having inflections disposed along the clip section to afford wings that assist in providing a snug fit of the mask in the nose and cheek area as shown in FIG. 12. The nose clip may be secured to the respiratory device by an adhesive, for example, a pressure sensitive adhesive or a liquid hot-melt adhesive. Alternatively, the nose clip may be encased in the body of the respiratory device or it may be held between the device body and a fabric or foam that is mechanically or adhesively attached thereto. In an embodiment of the invention such as is shown in FIG. 6 or FIG. 12, the nose clip is positioned on the outside part of the first member and a foam piece (not shown) is disposed on the inside part of the first member of the respiratory device in alignment with the nose clip.

The respiratory device may also include an optional exhalation valve, typically a diaphragm valve, which allows for the easy exhalation of air by the user. An exhalation valve having extraordinary low pressure drop during exhalation for the mask is described in U.S. Pat. No. 5,325,892 (Japuntich et al.) which is incorporated herein by reference. Many exhalation valves of other designs are well known to those skilled in the art. The exhalation valve is preferably secured to the central portion, preferably near the middle of the central portion, by sonic welds, adhesion bonding, mechanical clamping or the like.

Figure 14:
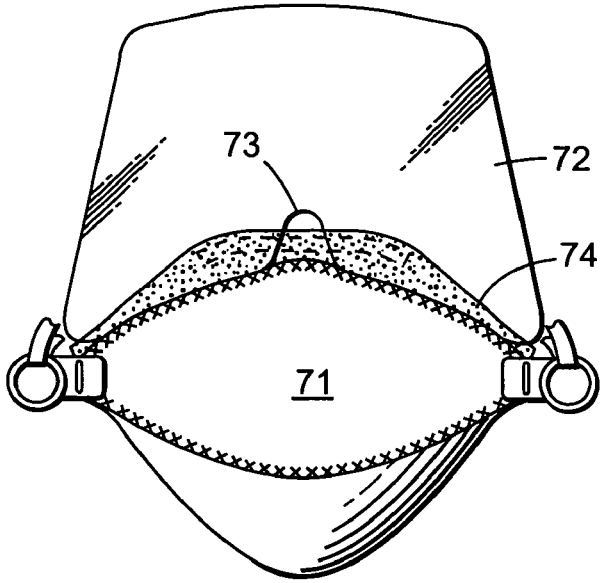
FIG. 14 is a front view of another embodiment of a personal respiratory protection device of the present invention.

The respiratory device may optionally have attached, at the upper edge or outboard portions of the respiratory device, a face shield. Typical face shields are disclosed, for example, in U.S. Pat. No. 2,762,368 (Bloomfield) and U.S. Pat. No. 4,944,294 (Borek, Jr.), which are incorporated herein by reference. Also useful is the type of face shield 72 disclosed in U.S. Pat. No. 5,020,533 (Hubbard et al.) and shown in FIG. 14, which has a cutout 73 proximate the center of the shield to facilitate conformance of the respiratory device 71 and shield 72 to the face of the wearer with a darkened strip 74 at the top edge of the device 71 to reduce glare, also incorporated by reference herein.

Figure 15:
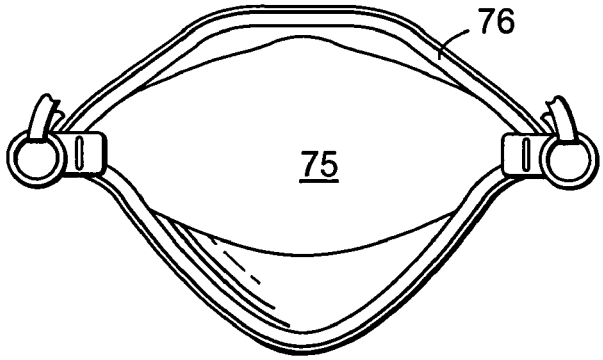
FIG. 15 is a rear view of another embodiment of a personal respiratory protection device of the present invention.

Further, face seals which minimize leakage of air between the device and the face may also optionally be used with the respiratory device of the present invention. Typical face seals are described, for example, in U.S. Pat. No. 4,600,002 (Maryyanek et al.), U.S. Pat. No. 4,688,566 (Boyce), and U.S. Pat. No. 4,827,924 (Japuntich), which describes a ring of soft elastomeric material 76 as in shown in FIG. 15 on respiratory device 75, each of which is incorporated herein by reference, as well as Canadian Pat. No. 1, 296,487 (Yard).

Figure 16:
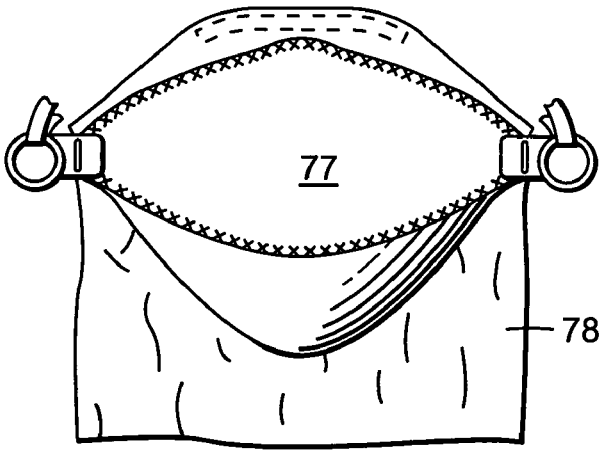
FIG. 16 is a front view of another embodiment of a personal respiratory protection device of the present invention.
Figure 17:
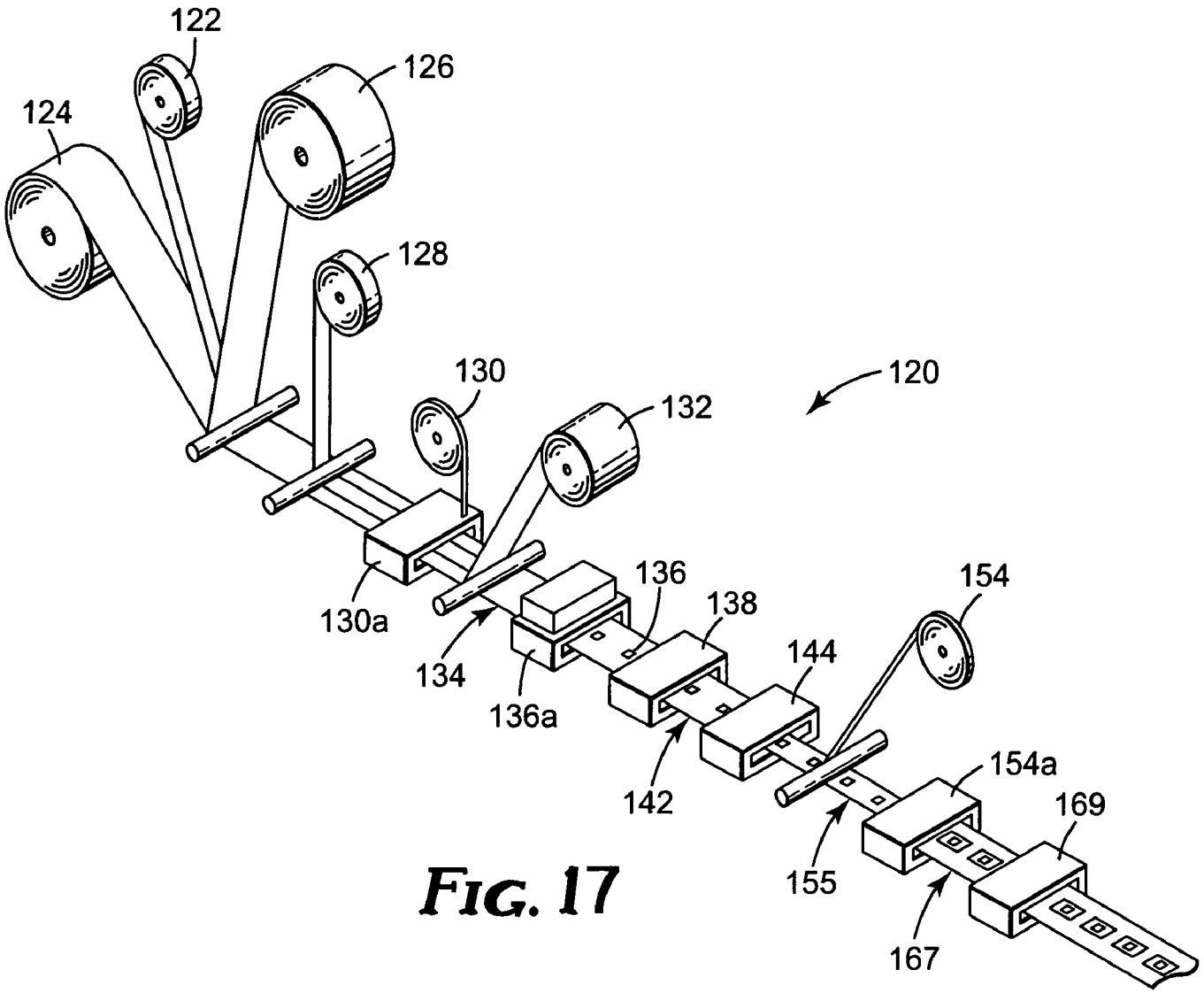
FIG. 17 is a schematic illustration of an exemplary manufacturing process for producing a flat-folded personal respiratory protection device.
Figure 18:
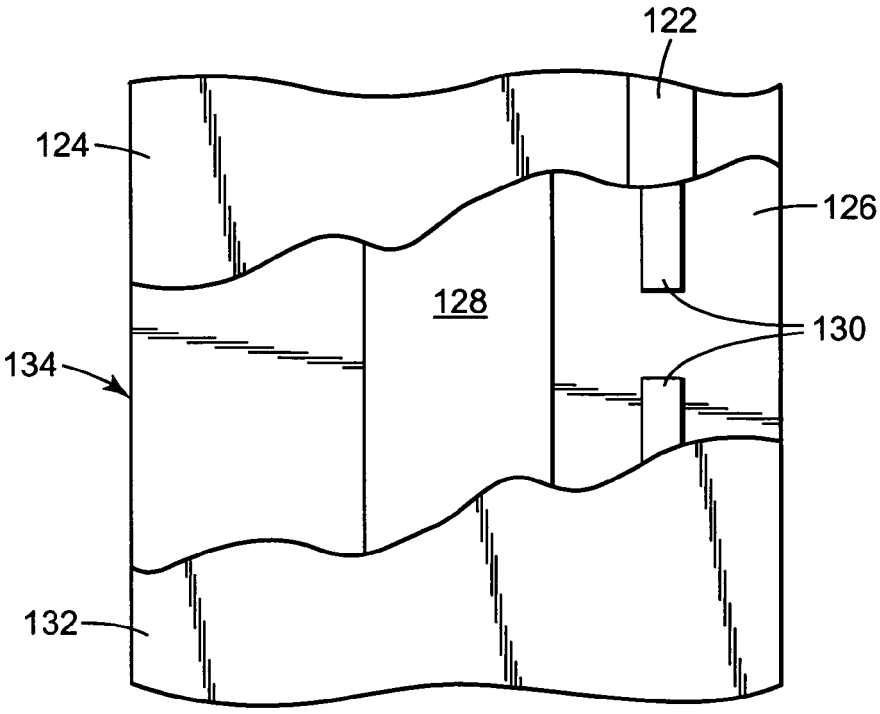
FIGS. 18–20 illustrate intermediate web configurations of the exemplary manufacturing process of FIG. 14.

Also, neck covers which protect the neck area from, for example, splashing liquids, may also be used with the respiratory devices of the present invention. Typical neck covers are disclosed, for example in U.S. Pat. No. 4,825,878 (Kuntz et al.), U.S. Pat. No. 5,322,061 (Brunson), and U.S. Design Pat. No. Des. 347,090 (Brunson), which are incorporated herein by reference. FIG. 16 shows a typical neck cover 78 on respiratory device 77.

The respiratory devices of the present invention can be sterilized by any standard method, such as gamma radiation, exposure to ethylene oxide, or autoclaving, although these processes may effect any charge which has been provide to the device.

The flat-folded personal respiratory protection devices of the present invention can be prepared by forming a flat central portion having at least a first edge and a second edge and attaching a flat first member to the central portion at the first edge of the central portion with a fold, bond or seam. The fold, bond or seam edge of the first portion is substantially coextensive with the first edge of the central portion. A flat second member is attached to the central portion at the second edge of the central portion with a fold, bond or seam. Again, the fold, bond or seam edge of the second member is substantially coextensive with the second edge of the central portion. At least one of the central portion, first and second members contains filter media.

The flat-folded respiratory devices shown in FIGS. 1–6 can be produced by forming a rectangular sheet of filtering media, folding a first long edge toward the center of the sheet to form a first member, folding the second long edge toward the center of the sheet to form a second member and sealing the nonfolded edges. The process may optionally include additional members attached to the first and second members at their unfolded edges through additional folds or bonds.

The flat-folded respiratory devices shown in FIGS. 7–12 can be produced by forming a first elliptical sheet of filter media having two-edges, forming a second elliptical sheet of filter media having two edges, at least one side of each sheet having a common shape, bonding the common shaped edges, folding the unbonded edge of the second sheet toward the bonded edge, forming a third elliptical sheet of filter media having two edges, at least one edge of which has a common shape with the unbonded edge of the first sheet, placing the third sheet on the second sheet and bonding the common shaped edges of the first and third sheet.

Each process is amenable to high speed production methods and may comprise additional steps as needed for attachment of headbands, nose clips, and other typical respiratory device components.

FIGS. 17–20 are schematic illustrations of a preferred high speed production process 120 for manufacturing a flat-folded respiratory devices such as shown in FIGS. 7–12. A foam portion 122 is preferably positioned between an inner cover web 124 and a filter media 126. In an alternate embodiment, the optional foam portion 122 and/or nose clip 30 may be positioned on an outer surface of either the inner cover web 124 or outer cover web 132. A reinforcing material 128 is optionally positioned proximate center on the filter media 126. A nose clip 130 is optionally positioned along one edge of the filter media 126 proximate the reinforcing material 128 at a nose clip application station 130*a*. The filter media 126, optional reinforcing material 128 and optional nose clip 130 are covered by an outer cover web 132 to form a web assembly 134 shown in cut away (see FIG. 18). The web assembly 134 may be held together by surface forces, electrostatic forces, thermal bonding an adhesive or any other suitable well-known means.

An exhalation valve 136 is optionally inserted into the web assembly 134 at a valving station 136*a*. The valving station 136*a* preferably forms a hole proximate the center of the web assembly 134. The edges of the hole may be sealed to minimize excess web material. The valve 136 may be retained in the hole by welding, adhesive, pressure fit, clamping, snap assemblies or some other suitable means. Exemplary respiratory devices with exhalation valves are illustrated in FIGS. 11 and 12.

Figure 19:
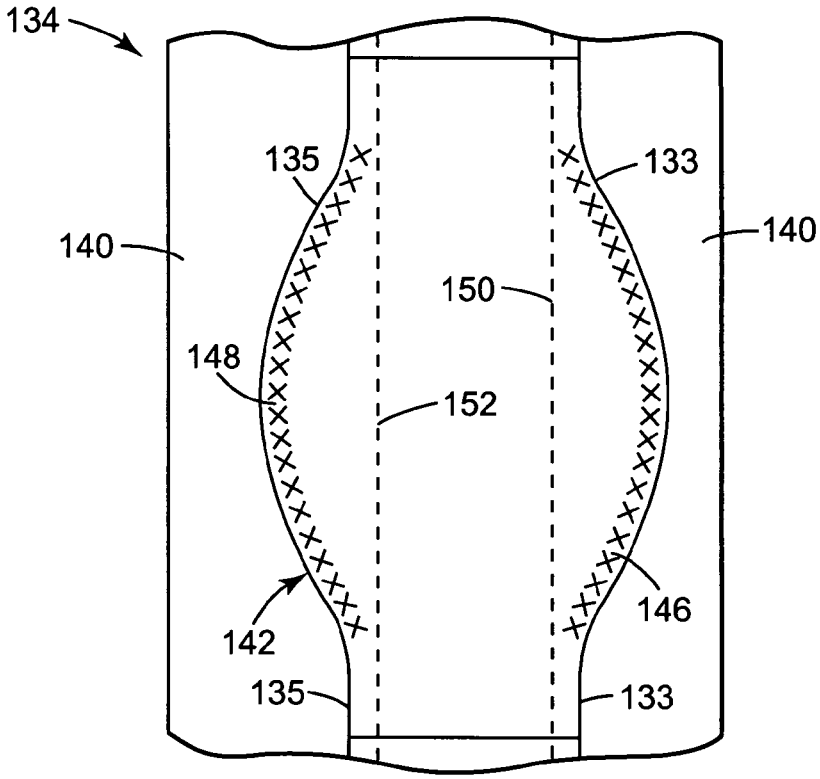

As is illustrated in FIG. 19, the web assembly 134 can be welded and trimmed along face-fit weld and edge finishing lines 133, 135 at face fit station 138. The excess web material 140 is removed and the trimmed web assembly 142 is advanced to the folding station 144. The folding station 144 folds first and second members 146, 148 inward toward the center of the trimmed web assembly 142 along fold lines 150, 152, respectively, to form a folded device blank 155 illustrated in FIG. 20.

The folded device blank 155 can be welded along edges 158, 160 at finishing and headband attaching station 154*a* to form a strip of respiratory devices 156 from which the excess material beyond the bond lines can be removed. The weld line 160 is adjacent to the face-fit weld and edge finishing lines 133. The face-fit weld and edge finishing line 135 is shown in dashed lines since it is beneath the first member 146. Headband material 154 forming a headband 161 is positioned on the folded device blank 155 along a headband path "H" extending between left and right headband attachment locations 162, 164. The headband 161 is preferably attached to the device blank 155 at left and right headband attachment locations 162, 164. Since the device blank 155 is substantially flat during the manufacturing process 120, the headband path "H" is an axis substantially intersecting the left and right attachment locations 162, 164.

When the headband is of the preferred material disclosed in allowed U.S. patent application Ser. No. 07/503,716, filed Mar. 30, 1990, it will be understood that it is possible to activate or partially activate the headband material 154 before, during or after application to the respiratory device blank 155. One preferred method is to activate the headband material 154 just prior to application by selectively clamping the yet unactivated headband material between adjacent clamps, elongating it the desired amount, laying the activated headband material 154 onto the device blank 155, and attaching the inactivated end portions of the headband material 154 to the device blank 155. Alternatively, the unactivated headband material 154 can be laid onto the device blank 155, attached at the ends as discussed herein and then activated prior to packaging. Finally, the headband material 154 can remain unactivated until activated by the user.

A longitudinal score line "S" may optionally be formed either before, during or after attachment of the headband material 154 to the device blank 155 at the finishing and headband attaching station 154*a* to create a multi-part headband. The edges 166, 168 of the device blank 155 adjacent to the left and right headband attachment locations 162, 164 may either be severed to form discrete respiratory devices or perforated to form a strip of respiratory devices 167 (see FIG. 21). The finished respiratory devices 167 are packaged at packaging station 169.

Figure 20:
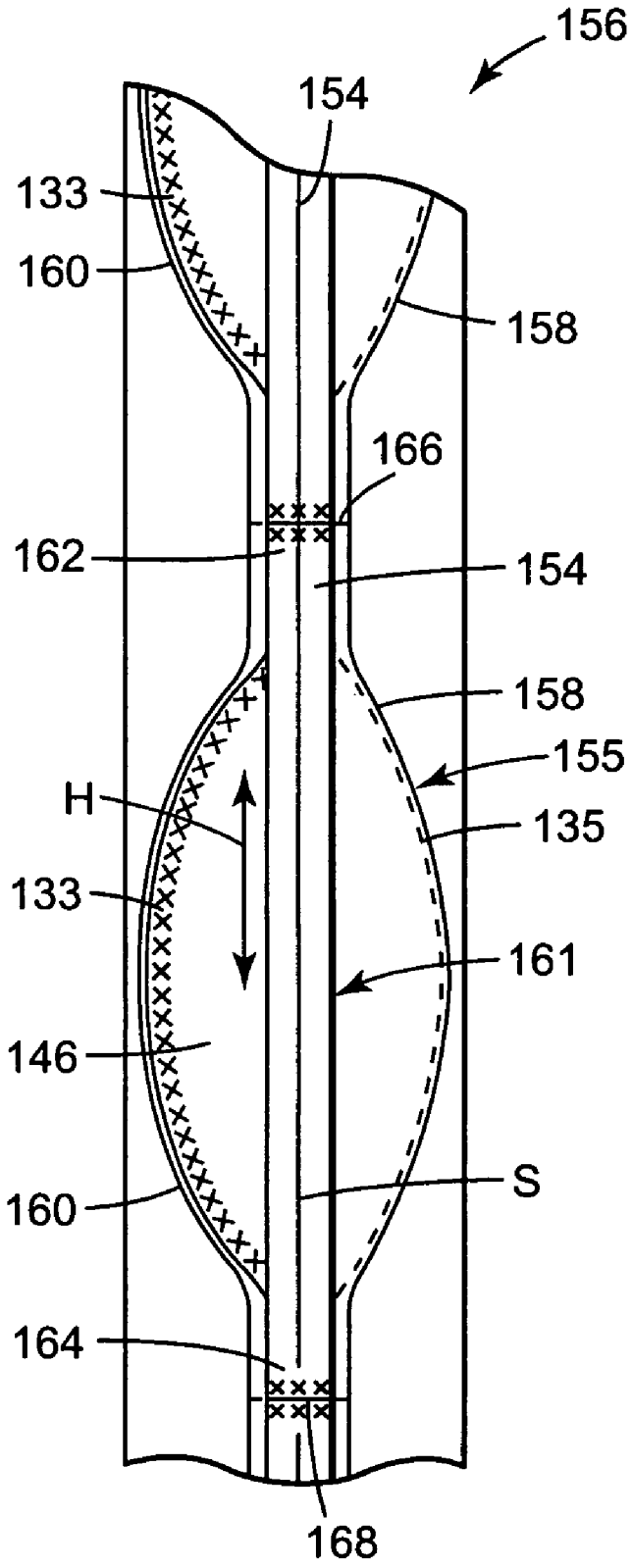
Figure 21:
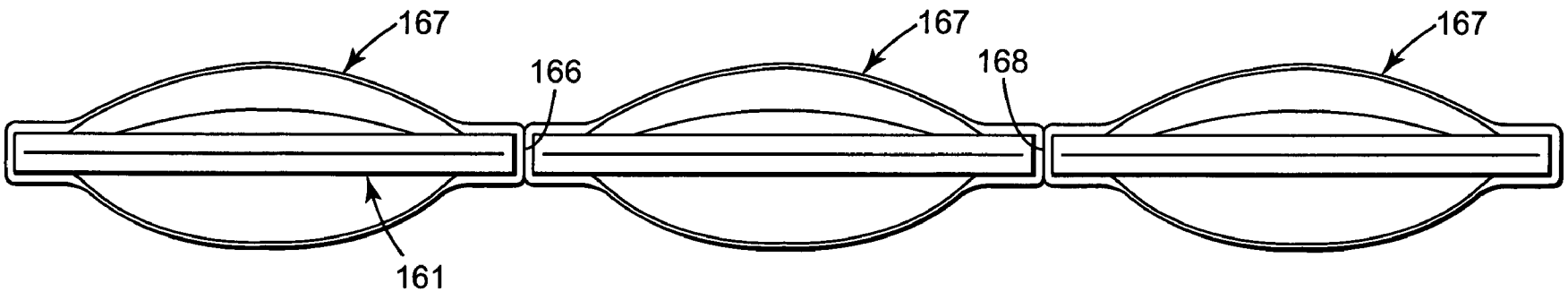
FIG. 21 illustrates a strip of face masks manufactured according to the process of FIGS. 17–20.

FIG. 21 illustrates a strip of flat-folded respiratory devices 167 manufactured according to the process of FIGS. 17–20. The edges 166, 168 are preferably perforated so that the respiratory device 167 can be packaged in a roll. A portion of the headband 161 at the edges 166, 168 has been removed by the perforation process. In an alternate embodiment, the headband 161 extends continuously past the edges 166, 168. FIG. 20 illustrates the multi-part headband 161 attached to the rear of the respiratory device 167, although it could be attached in any of the configurations disclosed herein. It will be understood that either a one-part or a multi-part headband 161 may be attached to either side of the respiratory device 167, in either a peel or shear configuration, although sheer is preferred.

When other types of headband material are used, the headband material is applied at the length desired in the final finished flat-folded respiratory device and attached at left and right headband attachment locations 162, 164.

The following examples further illustrate this invention, but the particular materials, shapes and sizes thereof in these examples, as well as other conditions and details should not be construed to unduly limit this invention.

EXAMPLES

Personal respiratory protection devices of the present invention are further described by way of the non-limiting examples set forth below:

Example 1

Two sheets (350 mm×300 mm) of electrically charged melt blown polypropylene microfibers were placed one atop the other to form a layered web having a basis weight of 100 g/m$^2$, an effective fiber diameter of 7 to 8 microns, and a thickness of about 1 mm. An outer cover layer of a light spunbond polypropylene web (350 mm×300 mm; 50 g/m$^2$, Type 1050B1UO0, available from Don and Low Nonwovens, Forfar, Scotland, United Kingdom) was placed in contact with one face of the microfiber layered web. A strip of polypropylene support mesh (380 mm×78 mm; 145 g/m$^2$, Type 5173, available from Intermas, Barcelona, Spain) was placed widthwise on the remaining microfiber surface approximately 108 mm from one long edge of the layered microfiber web and 114 mm from the other long edge of the layered microfiber web and extending over the edges of the microfiber surface. An inner cover sheet (350 mm×300 mm; 23 g/m$^2$, LURTASIL™ 6123, available from Spun Web UK, Derby, England, United Kingdom) was placed atop the support mesh and the remaining exposed microfiber web. The five-layered construction was then ultrasonically bonded in a rectangular shape roughly approximating the layered construction to provide bonds which held the layered construction together at its perimeter forming a top edge, a bottom edge and two side edges. The layers were also bonded together along the long edges of the support mesh. The length of the thus-bonded construction, measured parallel to the top and bottom edges, was 188 mm; and the width, measured parallel to the side edges was 203 mm. The edges of the strip of support mesh lay 60 mm from the top edge of the layered construction and 65 mm from the bottom edge of the construction. Excess material beyond the periphery of the bond was removed, leaving portions beyond the bond line at the side edges, proximate the centerline of the support mesh, 50 mm long×20 mm wide to form headband attachment means.

The top edge of the layered construction was folded lengthwise proximate the nearest edge of the support mesh to form an upper fold such that the inner cover contacted itself for a distance of 39 mm from the upper fold to form a first member, the remaining 21 mm of layered construction forming an additional portion. The bottom edge of the layered construction was folded lengthwise proximate the nearest edge of the support mesh to form a lower fold such that the inner cover contacted itself for a distance of 39 mm to form a second member, the remaining 26 mm forming an additional portion. The inner cover layer of the additional portions were then in contact with each other. The contacting portions of the central portion, lying between the upper and lower folds, the first member and the second member were sealed at their side edges.

A malleable nose clip about 5 mm wide×140 mm long was attached to the exterior surface of the additional portion attached to the first member and a strip of nose foam about 15 mm wide×140 mm long was attached to the inner surface of the additional portion substantially aligned with the nose clip. The additional portions were folded such that the outer covers of each contacted the outer cover of the first and second members, respectively.

The free ends of the layered construction left to form headband attachment means were folded to the bonded edge of the layered construction and bonded to form loops. Head band elastic was threaded through the loops to provide means for securing the thus-formed respiratory device to a wearer's face.

Example 2

First and second layered sheet constructions (350 mm×300 mm) were prepared as in Example 1 except the support mesh was omitted. A curvilinear bond was formed along a long edge of each sheet and excess material beyond the convex portion of the bond was removed. A third layered sheet construction was prepared as in Example 1 except each of the five layers was substantially coextensive. The first layered sheet construction was placed atop the third layered sheet construction with inner covers in contact. The first and third sheet constructions were bonded together using a curvilinear bond near the unbonded long edged of the first sheet construction to form an elliptical first respiratory device member having a width of 165 mm and a depth of 32 mm. The radius of each of the curvilinear bond was 145 mm.

The edge of the first sheet construction not bonded to the third sheet was folded back toward the edge of the first sheet which was bonded to the third sheet. The second sheet construction was placed atop the folded first sheet and partially covered third sheet. The second and third sheet construction were bonded together using a curvilinear bond to form an elliptical second respiratory device member from the second sheet having a width of 165 mm and a depth of 32 mm and an elliptical central respiratory device portion having a width of 165 mm and a height of 64 mm from the third sheet construction. The material outside the elliptical portions was removed. The first and second members were folded away from the central portion.

A malleable aluminum nose clip was attached to the exterior surface of the periphery of the first member and a strip of nose foam was attached to the interior surface in substantial alignment with the nose clip. Headband attachment means were attached at the points where the bonds between the central portion and the first and second members met, and head band elastic was threaded through the attachment means to form a respiratory device ready for a wearer to don.

The various modifications and alterations of this invention will be apparent to those skilled in the art without departing from the scope and spirit of this invention and this invention should not be restricted to that set forth herein for illustrative purposes.

What is claimed is:

1. A personal respiratory protection device comprising:

a) a flat substantially rectangular central portion having first and second edges, b) a flat first member joined to the first edge of the central portion through either a fold-line, seam, weld or bond, said fold, bond, weld or seam of said first member being substantially coextensive with said first edge of said central portion, and c) a flat second member joined to the second edge of the central portion through either a fold-line, seam, weld or bond, said fold, bond, weld or seam of said second member being substantially coextensive with said second edge of said central portion, at least one of the central portion and first and second members being formed from filter media, and said device being capable of being folded flat for storage with said first and second members being in at least partial face-to-face contact with a common surface of said central portion and, during use, being capable of forming a cup-shaped air chamber over the nose and mouth of the wearer with the unjoined edges of the central portion and first and second members said unjoined edges being adapted to contact and be secured to those nose, cheeks and chin of the wearer and the outer boundary of the unjoined edges which are adapted to contact the nose, cheeks and chin of the wearer being less than the perimeter of the device in the flat folded storage state.

2. The respiratory device of claim 1 wherein said central portion is about 160 to 220 mm in width and about 30 to 110 mm in height.

3. The respiratory device of claim 1 wherein said first member is rectangular.

4. The respiratory device of claim 3 wherein said first member is about 160 to 220 mm wide and about 30 to 110 mm deep.

5. The respiratory device of claim 1 wherein said second member is rectangular.

6. The respiratory device of claim 5 wherein said second member is about 160 to 220 mm wide and about 30 to 110 mm deep.

7. The respiratory device of claim 1 wherein said device further comprises an additional member attached to said first member by a fold, seam, weld or bond.

8. The respiratory device of claim 7 wherein said additional member is rectangular.

9. The respiratory device of claim 8 wherein said additional member is about 160 to 220 mm wide and about 5 to 95 mm deep.

10. The respiratory device of claim 1 wherein said device further comprises an additional member attached to said second member by a fold, seam, weld or bond.

11. The respiratory device of claim 10 wherein said additional member is rectangular.

12. The respiratory device of claim 11 wherein said additional member is about 160 to 220 mm wide and about 3 to 9 mm in depth.

13. The respiratory device of claim 1 further comprising an exhalation valve.

14. The respiratory device of claim 13 wherein the exhalation valve is located in the central portion of the respirator.

15. The respiratory device of claim 1 further comprising a face shield.

16. The respiratory device of claim 1 further comprising a face seal.

17. The respiratory device of claim 1 further comprising a neck cover.

* * * * *